United States Patent [19]

Maurer

[11] 4,006,339

[45] Feb. 1, 1977

[54] MICROWAVE HEATING APPARATUS WITH MULTIPLE COUPLING ELEMENTS AND MICROWAVE POWER SOURCES

[75] Inventor: John W. Maurer, Albany, N.Y.

[73] Assignee: General Electric Company, Schenectady, N.Y.

[22] Filed: Dec. 31, 1975

[21] Appl. No.: 645,795

[52] U.S. Cl. ..... 219/10.55 F; 219/10.55 A

[51] Int. Cl.[2] ..... H05B 9/06

[58] Field of Search ..... 219/10.55 F, 10.55 E, 219/10.55 M, 10.55 A, 10.55 R

[56] References Cited

UNITED STATES PATENTS

| | | | |
|---|---|---|---|
| 3,887,722 | 6/1975 | Douglas et al. | 219/10.55 A |
| 3,941,641 | 3/1976 | Heller, Jr. et al. | 219/10.55 M |

*Primary Examiner*—Arthur T. Grimley
*Attorney, Agent, or Firm*—Donald R. Campbell; Joseph T. Cohen; Jerome C. Squillaro

[57] ABSTRACT

A cut off conductive enclosure tube supports a plurality of wire-like energy coupling elements partially wrapped about a centrally located dielectric support tube for receiving a frankfurter or other material body. Each coupling element is excited by an independent low power source of microwave energy, the energy coupled to different regions of the body being absorbed thereby to provide isolation between coupling elements and sources. Continuous processing operations are possible, and a rectangular configuration and industrial heating applications are described.

14 Claims, 7 Drawing Figures

MICROWAVE HEATING APPARATUS WITH MULTIPLE COUPLING ELEMENTS AND MICROWAVE POWER SOURCES

BACKGROUND OF THE INVENTION

This invention relates to microwave apparatus for heating food and other material bodies, and more particularly to microwave heating apparatus using multiple energy coupling elements each with an independent microwave power source.

In the ordinary microwave oven a single high power microwave generator such as a magnetron tube is used in conjunction with a single coupler or antenna element, and the energy fills the entire oven cavity. There are difficulties at present with various schemes to use a plurality of low power sources such as microwave solid state devices. Although it is possible to combine the individual power outputs of a few low power sources into a single transmission line, the total power that can be produced is limited and is best utilized as the equivalent of a single higher power source. If multiple coupling elements are used in conjunction with a plurality of independent low power microwave sources, the problem to be overcome is that the individual sources may destructively interfere with one another. With the advent of solid state microwave oscillators, which at present are low power sources of microwave energy, it is apparent that it would be desirable, however, to have a microwave heating apparatus employing a plurality of independent low power sources in a useful, simple, and efficient manner.

SUMMARY OF THE INVENTION

In accordance with the invention, a microwave heating apparatus with multiple isolated energy coupling elements and power sources is comprised by an electrically conductive enclosure tube or tubular housing having small enough transverse dimensions to be cut off at a selected frequency so that microwave energy does not propagate through the tube. A plurality of electrically conductive coupling elements, typically made of wire or narrow flat ribbon, are mounted within the enclosure tube, spaced from one another, each at least partially supported by or in close proximity to a dielectric support member bounding a body receiving space for receiving the material body to be heated. In its broadest aspect the dielectric support member may not be required. A plurality of independent power sources for generating microwave energy at or above the selected frequency are provided, each coupling element being connected to a different one of the power sources. The spaced coupling elements couple energy to different regions of the material body which is substantially absorbed by the material being heated to provide isolation between coupling elements and hence sources. Thus, the total power available from a number of low power sources can be applied to the material without requiring prior combination of the individual powers. By extending the conductive enclosure tube at either end longitudinally beyond the coupling elements a sufficient distance, the microwave energy substantially decays, and thus continuous processing operations are possible.

In the cylindrical configuration the dielectric support member is a centrally located support tube for receiving frankfurters and similar material bodies. The coupling element preferably is a planar helix or a short cylindrical or conical helix partially wrapped about the support tube with a length of 1¼ to 1½ turns and a gradually curving transition between the enclosure and support tubes to achieve low reflection, the several coupling elements being spaced longitudinally. In a rectangular configuration for the industrial heating of sheet material, for example, the dielectric support member is planar and the coupling elements are spaced width-wise with a gradually curving transition from the cutoff rectangular enclosure tube to the planar support member to achieve low reflection.

DESCRIPTION OF THE PREFERRED EMBODIMENTS

Figure 1:
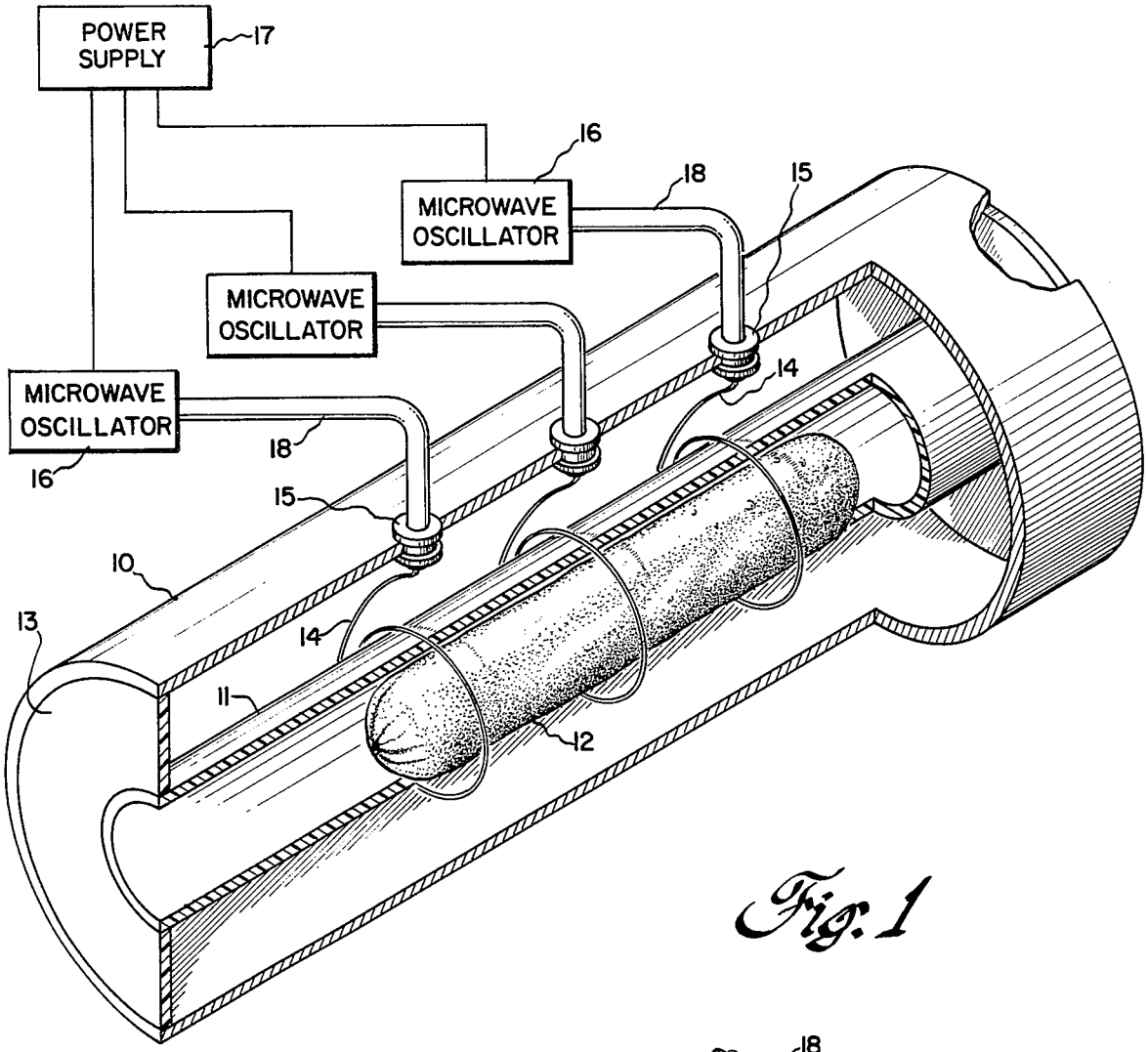
FIG. 1 is a schematic perspective view partially cut away and in section of a microwave heating apparatus constructed in accordance with the invention in a cylindrical configuration for heating frankfurters.
Figure 2:
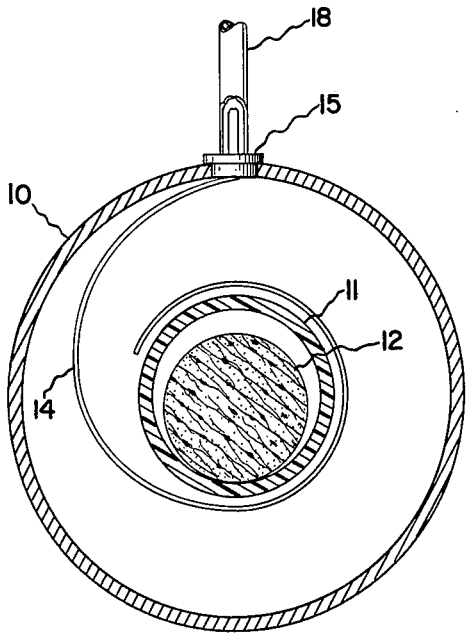
FIG. 2 is a vertical cross section taken through the microwave heating apparatus of FIG. 1.

The cylindrical embodiment of the microwave heating apparatus shown in FIGS. 1 and 2 is discussed with regard to warming or cooking frankfurters, although it can be used to heat other similar food items and has industrial applications for the heating of various appropriately shaped material bodies. As will be evident, the apparatus is suitable for continuous processing operations on a line of frankfurters fed end-first in sequence, or for heating single frankfurters one at a time. The microwave heating apparatus is comprised by an electrically conductive enclosure tube or tubular housing 10, typically made of copper or other suitable metal, having a small enough cross-section that all of the possible waveguide modes are cut off in the empty tube at the frequency of the generated energy, namely 2450 'MHz. Assuming a circular tubing or waveguide, the lowest order mode is the $TM_{01}$ mode which is cut off at a radius determined by the formula $\lambda_c = 3.4126r$. Thus, microwave energy does not propagate in the empty tube. Although higher order, evanescent modes may exist, the microwave energy decays substantially to a level that is not harmful to a human operator when enclosure tube 10 is extended axially at either end a sufficient distance beyond the coupling elements.

A dielectric support tube 11 for receiving the frankfurter 12 or other material body being heated is mounted centrally within enclosure tube 10. Support tube 11 is made of a low loss dielectric such as glass or plastic, and as illustrated is supported coaxially within enclosure tube 10 by means of a pair of end rings 13. Thus, support tube 11 is open at both ends and may also support a conveyor belt arrangement (not here shown) for the continuous processing of a line of frankfurters. A plurality of electrically conductive coupling elements 14 are mounted within enclosure tube 10, longitudinally spaced from one another, for coupling microwave energy to different regions of the body being heated. Coupling elements 14 preferably are made of metallic wire or can be made of flat ribbon having a width narrow as compared to the spacing between adjacent elements. Each energy coupling elements 14, which desirably has a planar helical or very short cylindrical or conical helical configuration, is partially wrapped around dielectric support tube 11. Consequently, the support tube not only supports the frankfurter but allows minimum spacing between it and the several coupling elements while keeping them mechanically isolated.

At its outer end each coupling element 14 is attached to a suitable insulated connector means 15 mounted in an opening in conductive enclosure tube 10, such as the insulated pin shown here schematically or the center connector of a coaxial input jack. A plurality of microwave oscillators 16 are provided, all independent from one another except that it is desirable to have a common power supply 17 with provision for isolation of the power supply. The microwave energy generated by each oscillator is coupled by means of a coaxial cable 18 or other transmission line to one of the insulated connector means 15. Thus, each coupling element 14 is excited by an independent power source, which consequently can be a low power source. Microwave oscillators 16 are preferably comprised by solid-state microwave devices, but other power sources can be used as may be appropriate.

Figure 3:
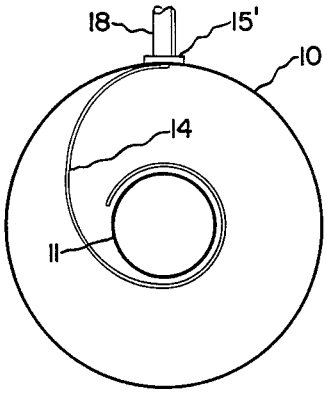
FIGS. 3–5 are cross-sectional and fragmentary longitudinal sketches illustrating a planar helical coupling element and short cylindrical or conical helical coupling element.
Figure 4:
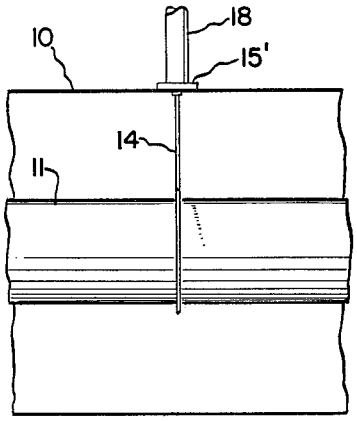
Figure 5:
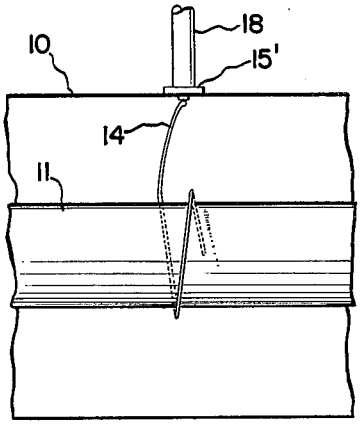

Referring to FIGS. 3–5, coupling element 14 has the properties of an impedance transformer and has a preselected length and configuration to couple energy into the material body being heated with low reflection. FIG. 4 shows a planar helix which for best results has a length between 1¼ and 1½ turns. For lowest reflection the helix includes a gradually curving transition section that initially follows the outer tube surface, smoothly transitioning to the smaller radius of curvature of the inner tube over about one-half of a turn. Assuming that a coaxial input jack 15' is used, the attachment to the center conductor should lie close to the tube surface to minimize the extension into the tube along the radial. It is observed that the end section wrapped around inner support tube 11, about ¾ of a turn to 1 turn, is long enough to allow the energy to be absorbed by the material. The alternate configuration of coupling element 14 shown in FIG. 5 is a very short conical or cylindrical helix also with a length of 1¼ to 1½ turns and a gradually curving transition between the two tubes 10 and 11. The planar helices allow close spacing of the individual inputs to the material being heated, while cylindrical helices allow coupling to the material over a longer axial length.

In operation, the several longitudinally spaced coupling elements 14, each associated with an independent low power source of microwave energy, couple energy to different regions of the material body being heated. The energy is substantially absorbed by the material body being heated to thereby provide substantial isolation between coupling elements 14, and hence between power sources 16. That is, each power source has as a load its own portion of the material to be heated, and is independent of other power sources except for the small amount of coupling that exists between the coupling elements 14 themselves. The use of multiple inputs allows the total power available from a number of sources to be applied to the material without requiring prior combination of these powers into a single transmission line. Relatively low power sources can be used, and each source can be inserted, tuned and operated independently of the others. Of course, all of the individual power sources usually operate at approximately the same selected frequency, but from a theoretical standpoint the substantial isolation obtained between power sources, assuming that enclosure tube 10 is cut off, allows the use of different operating frequencies. As was mentioned, since enclosure tube 10 is cut off when not filled with frankfurter or other absorbing material, and the absorption in the material strongly attenuates the input energy, very low leakage occurs with the ends left open when the tube is extended sufficiently at either end beyond the material. Accordingly, the coupling is applicable to continuous processing operations. Although only three separate inputs are illustrated in FIG. 1, it is evident that a larger number of inputs is possible according to the requirements of the application at hand. Further, since heating by conduction is required to distribute the heat from under a planar or short cylindrical helical coupling element, the separation of inputs and the rate of microwave heating are related.

Figure 6:
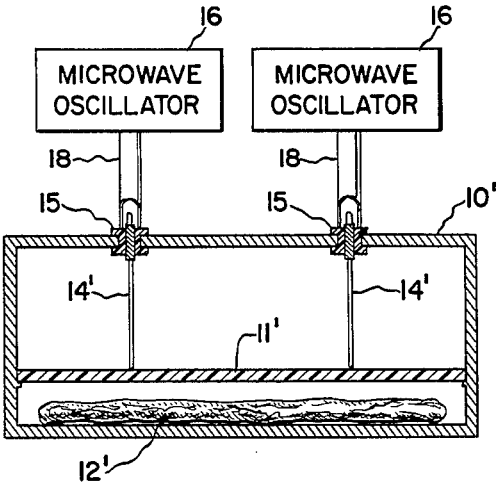
FIG. 6 is a schematic vertical cross section of a microwave heating apparatus in a rectangular configuration for heating sheet material.
Figure 7:
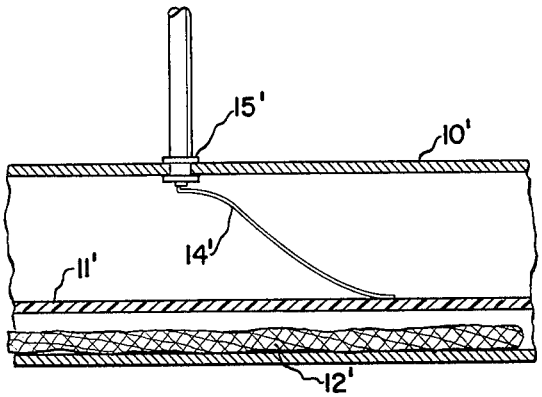
FIG. 7 is a fragmentary longitudinal sketch through the apparatus of FIG. 6 showing the shape of the coupling element.

FIGS. 6 and 7 show a microwave heating apparatus with a rectangular configuration for heating a flat material body such as sheet material 12'. In order to be cut off at the applicable industrial heating frequency, so that the $TE_{10}$ mode does not propagate, rectangular enclosure tube 10' is less than ½ wavelength in width. A planar dielectric support member 11' is ordinarily supported parallel to the bottom wall of enclosure tube 10' thereby defining a body receiving space open at both ends for receiving sheet material 12'. A plurality of conductive, wire-like energy coupling elements 14' are mounted within the enclosure tube, spaced widthwise from one another a sufficient distance so as to be substantially isolated under operating conditions. For low reflection, coupling element 14' has a gradually curving transition between insulated connector means 15 or 15' and support member 11', with an end portion parallel to and supported on support member 11'. In the same fashion as has been explained, each coupling element 14' is excited by an independent low power microwave source. Enclosure tube 10' is also extended at either end beyond the row of coupling elements 14' a sufficient distance so that microwave energy substantially decays, and sheet material 12' can be moved either continuously or intermittently beneath the energy coupling elements.

In accordance with the invention as more broadly defined, the inclusion of dielectric support tube 11 and planar dielectric member 11' is not essential, since the material body in some cases may be supported exterior to enclosure tube 10 in FIG. 1 or is adequately supported by the bottom wall of rectangular tube 10' in FIG. 6. In this event it is evident that a body receiving space is defined within the enclosure tube, with each coupling element 14 or 14' at least partially in close proximity to the body receiving space. Consequently, energy generated by each power source is coupled to a different region of the material body being heated and substantially absorbed by the material to thereby provide isolation between coupling elements and hence power sources.

While the invention has been particularly shown and described with reference to several preferred embodiments thereof, it will be understood by those skilled in the art that various changes in form and details may be made therein without departing from the spirit and scope of the invention.

The invention claimed is:

1. A microwave heating apparatus comprising an electrically conductive enclosure tube having transverse physical dimensions such that the enclosure tube is cut off at a selected microwave frequency and does not propagate energy, a plurality of electrically conductive energy coupling elements mounted within said enclosure tube each with at least a portion thereof in close proximity to a body receiving space for a material body to be heated, a plurality of independent power sources for generating microwave energy at approximately the selected frequency, and means for connecting each coupling element to a different one of said power sources, said coupling elements being spaced from one another so that energy coupled to different regions of the material body being heated is substantially absorbed thereby to provide isolation between the coupling elements.

2. A microwave heating apparatus according to claim 1 wherein said enclosure tube extends longitudinally at either end beyond the coupling elements a sufficient distance so that microwave energy substantially decays.

3. A microwave heating apparatus according to claim 1 further including a dielectric support member mounted within said enclosure tube at the boundry of said body receiving space, the portion of each coupling member in close proximity to the body receiving space being supported by said dielectric support member.

4. A microwave heating apparatus according to claim 1 further including a dielectric support tube mounted centrally within said enclosure tube and enclosing said body receiving space, said coupling elements each being a planar helix partially wrapped about said dielectric support tube.

5. A microwave heating apparatus according to claim 1 further including a dielectric support tube mounted centrally within said enclosure tube and enclosing said body receiving space, said coupling elements each being a short cylindrical helix partially wrapped about said dielectric support tube.

6. A microwave heating apparatus comprising an electrically conductive enclosure tube having transverse physical dimensions such that the enclosure tube is cut off at a selected microwave frequency and does not propagate lowest order mode energy, a dielectric support tube mounted centrally within said enclosure tube and enclosing a body receiving space for a material body to be heated, a plurality of electrically conductive, wire-like energy coupling elements within said enclosure tube each partially wrapped around said dielectric support tube, a plurality of independent power sources for generating microwave energy at approximately the selected frequency, and means for connecting each coupling element to a different one of said power sources including transmission line means and also insulated connector means mounted in an opening in said enclosure tube and to which the other end of the respective coupling element is attached, said coupling elements being spaced longitudinally from one another so that energy coupled to different regions of the body being heated is substantially absorbed thereby to provide isolation between the coupling elements.

7. A microwave heating apparatus according to claim 6 wherein each coupling element is a planar helix.

8. A microwave heating apparatus according to claim 7 wherein each planar helix coupling element has a gradually curving transition between said dielectric support tube and the respective insulated connector means and further has a length sufficient to achieve low reflection.

9. A microwave heating apparatus according to claim 6 wherein each coupling element is a short cylindrical helix.

10. A microwave heating apparatus according to claim 9 wherein each short cylindrical helix coupling element has a gradually curving transition between said dielectric support tube and the respective insulated connector means and further has a length sufficient to achieve low reflection.

11. A microwave heating apparatus according to claim 6 wherein said conductive enclosure tube and dielectric support tube are cylindrical and extend longitudinally at either end beyond the coupling elements a sufficient distance so that microwave energy substantially decays, at least said dielectric support tube being open-ended at both ends.

12. A microwave heating apparatus comprising an electrically conductive rectangular enclosure tube having a width such that the enclosure tube is cut off at a selected microwave frequency and does not propagate lowest order mode energy, a longitudinally extending planar dielectric support member mounted within said enclosure tube and defining a body receiving space for a material body to be heated, a plurality of electrically conductive, wire-like energy coupling elements within said enclosure tube each having one end portion parallel to and supported on said dielectric support member, a plurality of independent power sources for generating microwave energy at approximately the selected frequency, and means for connecting each coupling element to a different one of said power sources including transmission line means and also insulated connector means mounted in an opening in said enclosure tube and to which the other end of the respective coupling element is attached, said coupling elements being spaced width-wise from one another so that energy coupled to different regions of the body being heated is substantially absorbed thereby to provide isolation between the coupling elements.

13. A microwave heating apparatus according to claim 12 wherein said conductive enclosure tube and dielectric support member are extended longitudinally at either end beyond the coupling elements a sufficient distance so that microwave energy substantially decays.

14. A microwave heating apparatus according to claim 13 wherein each coupling element has a gradually curving transition between the respective insulated connector means and said planar dielectric support member.

* * * * *